US005269573A

United States Patent [19]

Rear

[11] Patent Number: 5,269,573

[45] Date of Patent: Dec. 14, 1993

[54] DEVICES FOR RESTRICTING THE MOVEMENT OF DOORS

[76] Inventor: Bernard A. Rear, Burland House, Swillington Lane, Swillington, Leeds LS26 BQU, United Kingdom

[21] Appl. No.: 863,294

[22] PCT Filed: Aug. 27, 1991

[86] PCT No.: PCT/GB91/01439

§ 371 Date: Jun. 29, 1992

§ 102(e) Date: Jun. 29, 1992

[87] PCT Pub. No.: WO92/03630

PCT Pub. Date: Mar. 5, 1992

[30] Foreign Application Priority Data

Aug. 28, 1990 [GB] United Kingdom ..... 9018756

[51] Int. Cl.[5] ..... E05C 17/50

[52] U.S. Cl. ..... 292/257; 292/DIG. 15; 292/DIG. 7; 292/207; 292/199

[58] Field of Search ..... 292/197, 207, 227, 257, 292/DIG. 7, DIG. 15, 199

[56] References Cited

U.S. PATENT DOCUMENTS

| | | | |
|---|---|---|---|
| 160,285 | 3/1875 | Royle | 292/DIG. 15 X |
| 343,298 | 6/1886 | Conn | 292/DIG. 15 X |
| 1,081,634 | 12/1913 | Smith | 292/210 X |
| 1,157,376 | 10/1915 | Franchaerts | 292/DIG. 15 X |
| 2,325,914 | 6/1941 | Moberg | 292/230 |
| 2,955,860 | 10/1960 | Jacques | 292/63 |
| 4,163,574 | 8/1979 | Cheyem | 292/DIG. 15 X |
| 4,514,000 | 4/1985 | Cheyem et al. | 292/DIG. 15 X |
| 4,807,914 | 2/1989 | Fleming et al. | 292/DIG. 7 |

FOREIGN PATENT DOCUMENTS 2228974 9/1990 United Kingdom .

*Primary Examiner*—Richard E. Moore

*Attorney, Agent, or Firm*—Jacobson, Price, Holman & Stern

[57] ABSTRACT

A device for restricting the opening motion of a door comprises a housing (4) for securing to the door and having an opening (6) facing the floor over which the door moves when it is opened and closed. A pivotally movable cam member (5)(5') is mounted within the housing so that it can pivot between an operating position in which it extends through the opening to engage with the floor and prevent opening movement of the door and a retracted position in which it is spaced from the floor. Levers (18,21) (18',21') are provided for moving the cam member between its operating and retracted positions.

6 Claims, 6 Drawing Sheets

DEVICES FOR RESTRICTING THE MOVEMENT OF DOORS

FIELD OF THE INVENTION

This invention relates to a device for restricting the movement of a door and, more particularly, is concerned with such a device which can be actuated to prevent unwanted entry through the door.

BRIEF SUMMARY OF THE INVENTION

According to the present invention there is provided a device for restricting the opening motion of a door so as to prevent unauthorized entry via the door which device comprises:

(i) a housing for securing to the door and having an opening facing the floor over which the door moves when being opened and closed, (ii) a cam member mounted for pivotal movement within the housing between an operating position in which it extends through said opening to engage with the floor and prevent opening movement of the door with respect to the floor and a retracted position in which it is spaced from the floor, and (iii) means for moving the cam member between its operating and retracted positions.

If desired, the cam member may be a roller of circular section and mounted for rotational movement about an axis which is eccentric with respect to the roller so that when pivoted about the axis the roller protrudes through the opening so as to occupy the operating position and retracts from the opening to occupy the retracted position. Preferably, however, the cam member is a roller of elliptical or other eccentric cross section appropriately mounted about an axis in the housing so that on rotation about the axis it protrudes beyond or is retracted within the opening so as to occupy the aforementioned operating and retracted positions, respectively. In either case, since a part only of the roller surface needs to cooperate operate with the floor in use of the device, the cam member may be in the form of part only of a roller.

It is particularly advantageous for the arrangement to be such that the cam member is bi-stable whereby, when it is not in one or other of the operating and retracted positions, it tends to move to one or other of those positions.

The means for moving the cam member between its operating and retracted positions may be in the form of first and second members in the form of foot operated levers which, on operation, cause the cam member to rotate between its operating and retracted positions. Any suitable means may be provided to mechanically link the levers to the cam member to convert the movement of the levers to the desired rotational movement of the cam member. Thus, for example, rectilinear movement of the lever may cause it to engage with an abutment on the cam member so as to move it from one of its operating and retracted positions to the other. Alternatively, the lever and the cam member may be linked by a rack and pinion mechanism to effect the desired rotational movement.

The housing may be formed of a polycarbonate resin or other suitable synthetic plastics material having a high mechanical and impact strength. Alternatively, it may be formed of a suitable metal such as brass or aluminium which may optionally be coated with plastics material by means of a powder coating technique. The roller may be formed of a synthetic plastics material or a metal such as steel and is preferably provided with a slip-resistant surface.

BRIEF DESCRIPTION OF THE DRAWINGS

For a better understanding of the invention and to show how the same may be carried into effect, a detailed description follows with reference, by way of example, to the accompanying drawings wherein.

DETAILED DESCRIPTION

Figure 1:
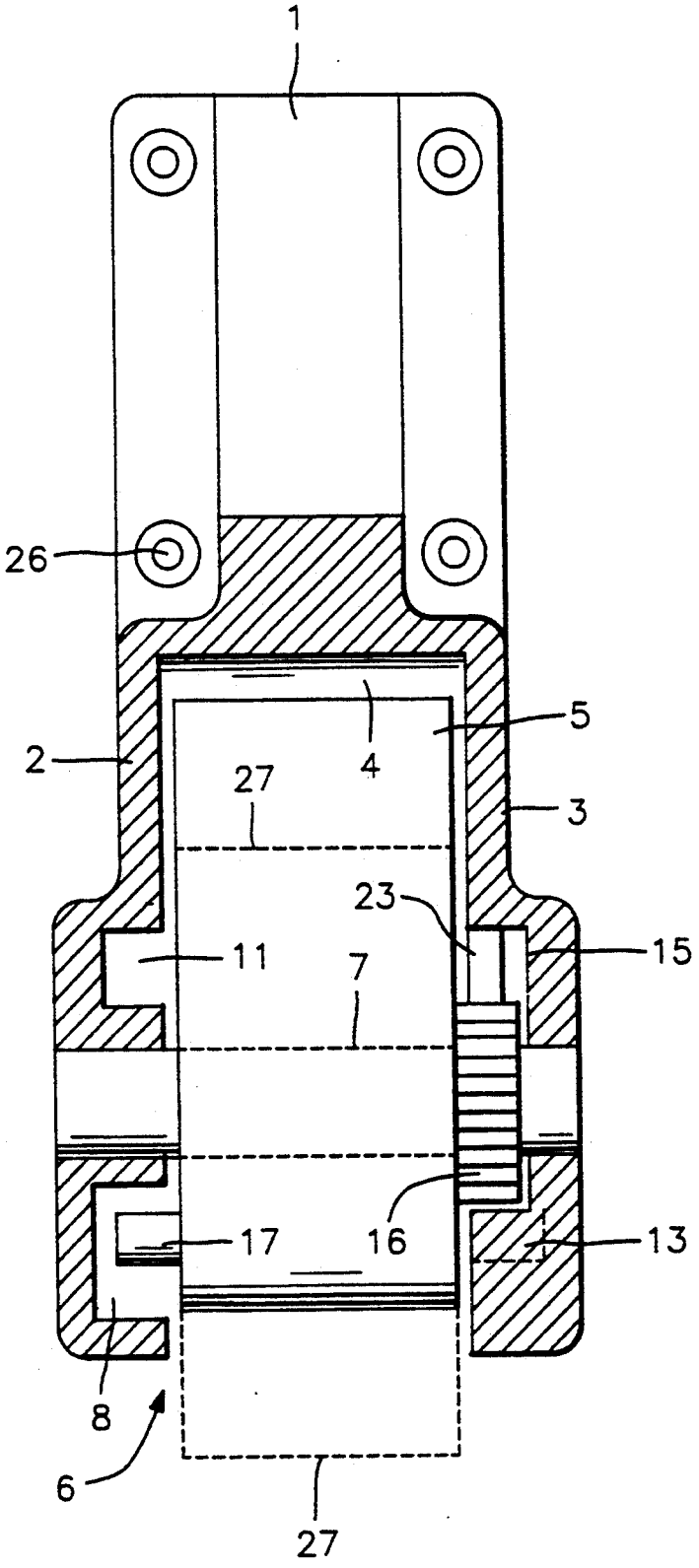
FIG. 1 is a vertical section through a first embodiment of a device in accordance with the present invention.
Figure 2:
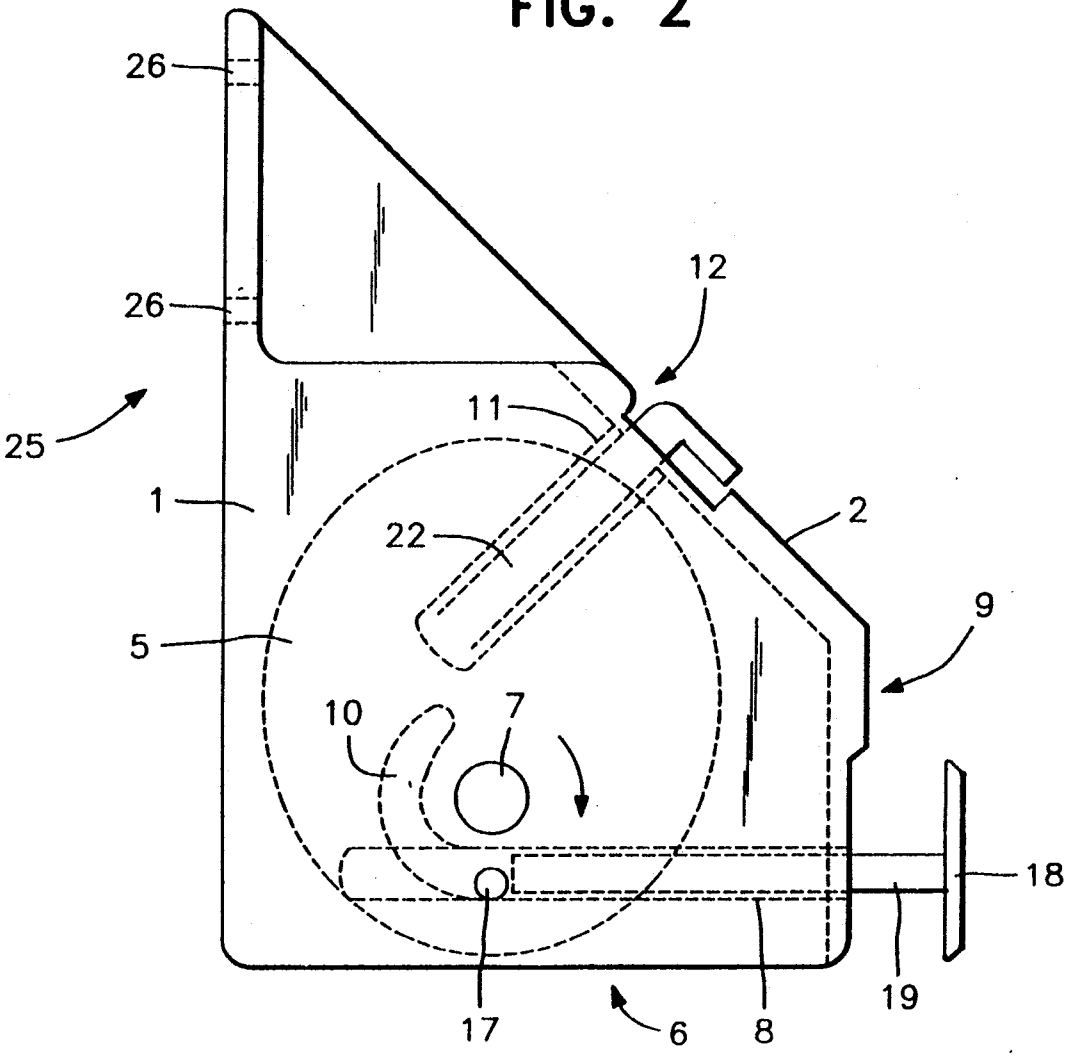
FIG. 2 is a view of a first side of the device of FIG. 1.
Figure 5:
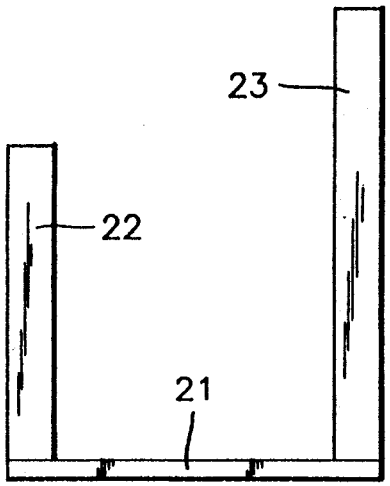
FIG. 5 is a plan view of the other of the operating levers of the device of FIGS. 1, 2 and 3.
Figure 4:
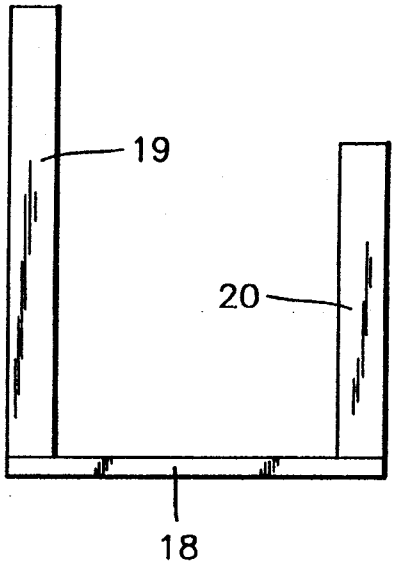
FIG. 4 is a plan view of one of the operating levers of the device of FIGS. 1, 2 and 3.
Figure 3:
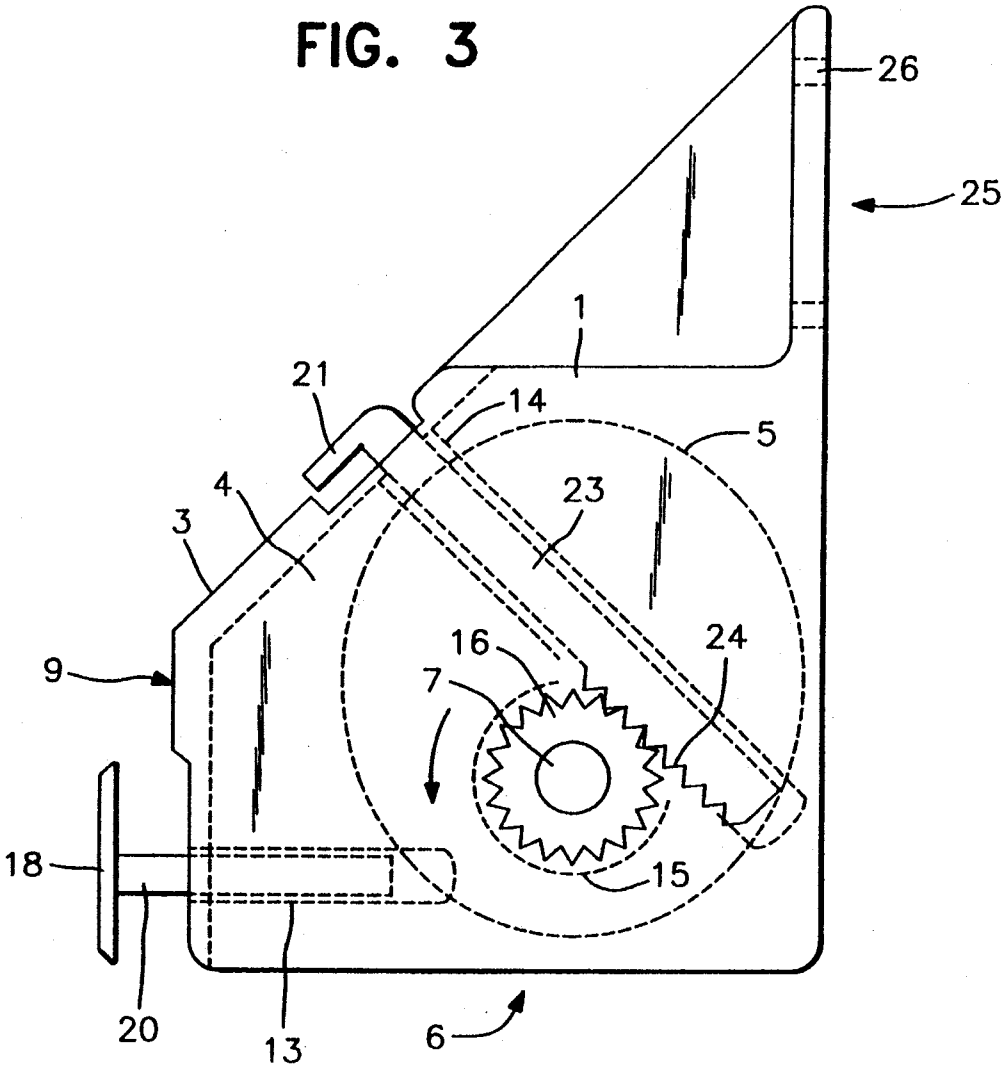
FIG. 3 is a view of a second side of the device of FIG 1.

Referring to FIGS. 1 to 5 of the drawings, the device comprises a casing 1 formed of a suitable metal or synthetic plastics material comprising first and second side members 2 and 3 which are appropriately secured together to form a housing 4 to receive a cam member and having an opening 6 at the bottom.

The cam member is in the form of a steel roller 5 of generally elliptical cross section and mounted for rotation on a steel spindle 7 passing through the roller 5 in the vicinity of one of the focal points of the ellipse of the cross section. The ends of the spindle 7 are mounted in apertures provided in members 2 and 3. The spindle 7 is tapered slightly and one of the apertures is greater than the other so that the spindle can be inserted into the housing from one direction only.

The inner face of wall member 2 includes a first rectilinear groove 8 extending from the front face 9 of the device generally parallel to the plane of the opening 6. The groove 8 bifurcates within the housing so that one portion continues in a rectilinear direction whereas another portion 10 extends along the arc of a circle having, as its centre, the longitudinal axis of the spindle 7. The inner face of member 2 also includes a second groove 11 extending from the inclined surface 12 of the device tangentially with respect to the axis of the spindle 7.

The inner face of member 3 is also provided with a pair of grooves. One of these grooves, groove 13, is in a location corresponding to groove 8 but is somewhat shorter and does not include an arcuate portion. The other groove, groove 14, generally corresponds to groove 11 except that it is tangential to a circular recess 15 having its centre co-incident with the axis of the spindle 7. Moreover, groove 14 is generally longer than groove 11.

The roller 5 has its periphery coated in slip resistant material and it carries an integral gear wheel 16 on its side face nearest to member 3. The gear wheel is coaxial with the axis of spindle 7 and lies within the circular recess 15 in member 3. On its side face nearer to member 2, the roller 5 includes an abutment in the form of a lateral stud 17 which protrudes into the rectilinear part of groove 8.

The device includes a first lever 18 which comprises a first longer actuating limb 19 and a second shorter guide limb 20 which extend into grooves 8 and 13 respectively. The device also includes a second lever 21 including a first shorter guide limb 22 and a second longer actuating limb 23 arranged to enter into grooves 11 and 14, respectively. Limb 23 includes an edge carrying serrations 24 which cooperate with the teeth on gear wheel 16 in the manner of a rack and pinion.

In use, the rear face 25 of the device is secured to the bottom part of that face of the door which is foremost during opening of the door. It is located on the door adjacent to the edge which is most remote from the hinge so that the opening 6 is facing towards the floor over which the door moves when opening and closing and is fastened to the door by suitable screws passing through holes 26. When it is desired to prevent opening movement of the door, the lever 18 (which is in an outer position as shown in the drawings) is actuated by the foot of the user so that the limbs 19 and 20 move along grooves 8 and 13 and the lever 18 occupies an inner position nearer the front face 9 of the device. As a result of the movement of lever 18, the free end of limb 19 abuts against the lateral stud 17 on the roller 5 and causes the roller to pivot about the axis of spindle 7 in the direction shown by the arrows with the stud 17 following the arcuate portion 10. Thus, as a consequence of the eccentricity, the roller 7 protrudes through the opening 6 to occupy its operating position shown in dotted lines 27 in which a surface of the roller engages the floor. Once the roller 5 has reached and passed a top dead centre position, the weight of the roller 5 is sufficient to cause it to rapidly assume the operating position 27. Any further attempt to open the door can only cause the roller 5 to pivot further in the direction shown by the arrows which causes the roller to engage the floor even more firmly and to resist opening movement of the door.

As a consequence of the roller 5 occupying its operating position 27, the lever 21 (which is shown in an inner position in the drawings) will have been driven outwardly along the grooves 11 and 14 by the interengagement of the serrations 24 with the teeth of the gear wheel 16 so that it occupies an outer position more remote from the front face 9 of the device. When it is desired to release the door so that it can open normally, the lever 21 is depressed by the foot of the user so that it returns to its inner position. This causes the roller 5 to pivot in the direction opposite to that indicated by the arrows so that its floor-engaging surface lifts away from the floor and the roller is retracted into the housing 4. Again, as the roller 5 passes its top dead centre position, it automatically rotates about the axis of spindle 7 until it rests against the rear face of the housing. This rotational movement of the roller 5 causes the stud 17 to engage with the free end of the limb 19 of lever 18 and thus lever 18 is caused to return to its outer position. The device is then ready for use again to prevent opening movement of the door.

Figure 6:
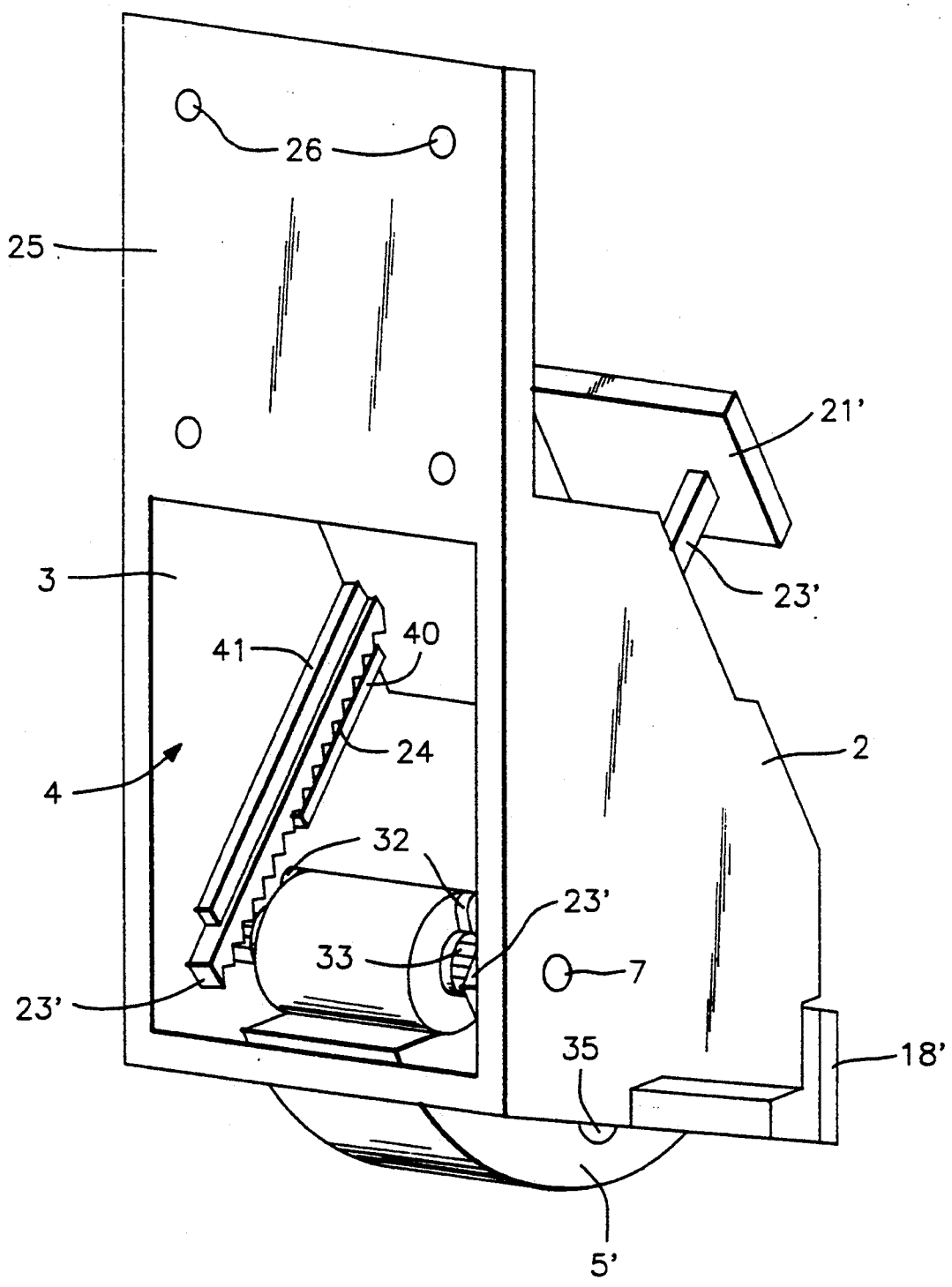
FIG. 6 is a perspective view from the rear face of a second embodiment of a device in accordance with the present invention wherein the cam member is in its operating position.
Figure 7:
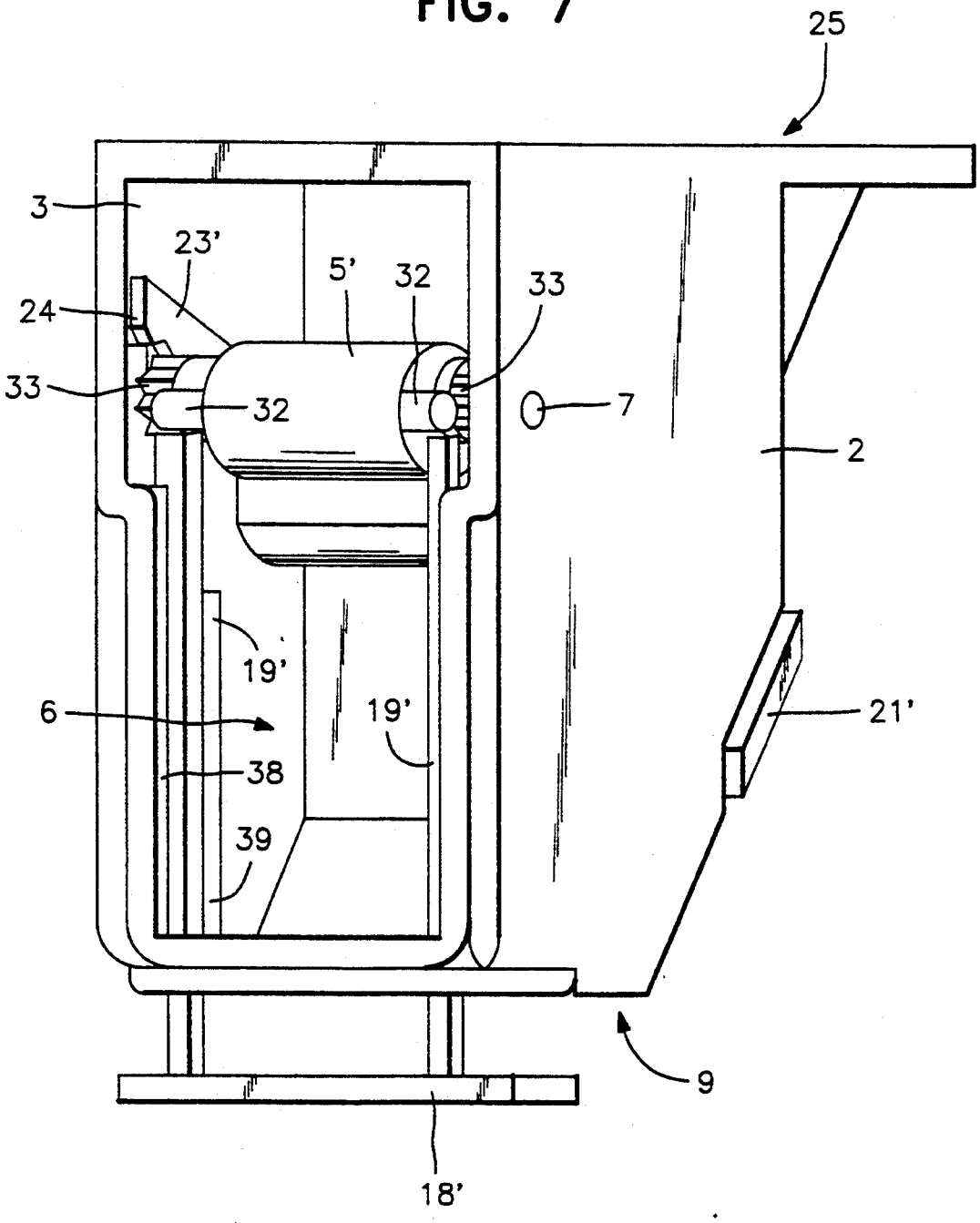
FIG. 7 is a perspective view from the bottom of the device of FIG. 6 wherein the cam member is in its retracted position.
Figure 8:
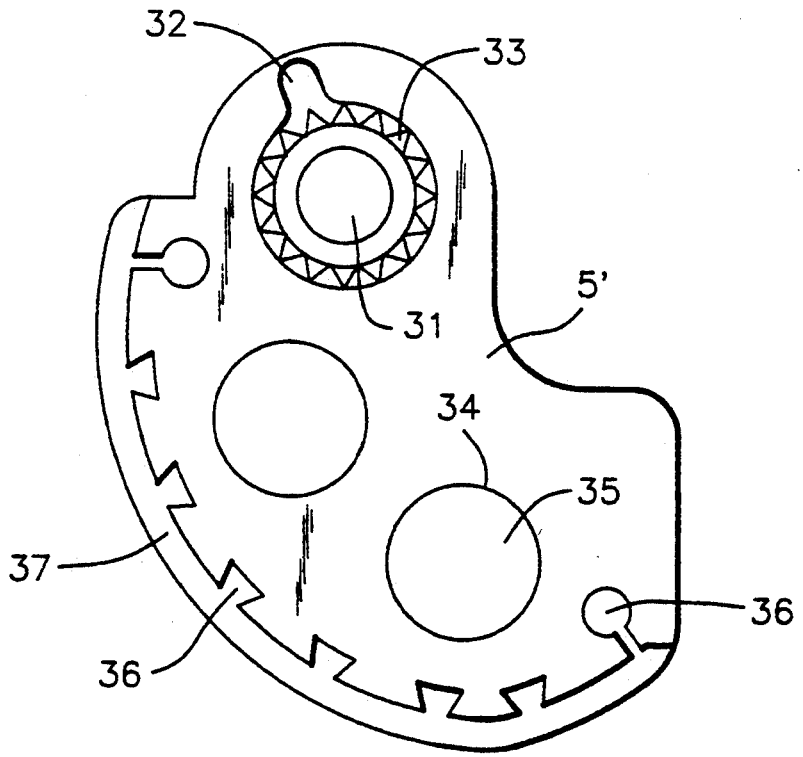
FIG. 8 is a side view of the cam member of the device 6 and 7.

Referring now to FIGS. 6, 7 and 8, there is shown another embodiment of the device of the present invention. In these Figures, parts corresponding to parts of the device of FIGS. 1 to 5 are denoted by like reference numerals.

As in the case of the first embodiment, the device includes a casing comprising first and second side members 2 and 3 forming a housing 4 to receive a cam member 5' and having an opening 6 at the bottom. In this case the side members 2 and 3 are formed integrally of plastics material by moulding.

The cam member 5' includes a body portion in the form of a part of a cylindrical roller mounted for pivotal movement about the axis of spindle 7. The cam member 5' is moulded from synthetic plastics material and includes a bore 31 to receive the spindle 7. The bore 31 is eccentrically located with respect to the longitudinal axis of the cylindrical roller of which the cam member 5' is a part. At each side of the cam member 5' there is provided an axial projection integrally formed with the cam member and concentric with the bore 31. Each projection includes an abutment in the form of a radially extending lug 32 and terminates in a portion provided with gear teeth 33. The cam member includes a second bore 34 at an end remote from the bore 31 and this second bore 34 may accommodate a heavy mass 35 such as a metal bar or high density rubber material so as to increase the weight of that end of the cam member. The body portion of the cam member includes a plurality of keys 36 in its surface and a non-slip coating of rubber 37 is anchored in the keys 36. The coating 37 is applied to the body portion by inserting the body portion into a suitable mould and introducing rubber material into the mould so that it enters the keys and becomes mechanically engaged with the body portion.

The inner surface of each of the side members 2 and 3 is provided with first integral guide members 38 and 39 defining a first channel therebetween to receive first and second actuating limbs 19' of a first lever 18'. The limbs 19' are reciprocable within the channels in the side members 2 and 3 and each includes an abutment (not shown) to prevent complete withdrawal of the first lever 18' from the housing. The free ends of each of the limbs 19' are arranged so as to be cooperable with the lugs 32 of the cam member 5'.

The inner surface of each of the side members 2 and 3 is also provided with second integral guide members 40 and 41 defining a second channel therebetween. The device includes a second lever 21' including two actuating limbs 23' which are reciprocable in the second channels. Limbs 23' include serrations 24 which co-operate with the gear teeth 33 on the axial projections at the sides of the cam member 5'. Thus, as the actuating limbs 23' slide along the second channels in the side members, the cam member 5' is caused to pivot about spindle 7 as a consequence of the engagement between the serrations 24 and the gear teeth on the cam member 5' in the manner of a rack and pinion. Abutments (not shown) are provided on limbs 23' to prevent complete withdrawal of the second lever 21' from the housing.

In use, the device is fixed to the door via screws passing through holes 26 in exactly the same manner as the device of the first embodiment. When it is desired to prevent opening movement of the door, the lever 18' (which is in its outer position as shown in FIG. 7) is actuated by the foot of the user so that the limbs 19' move along their respective channels in side members 2 and 3 so that the lever 18' occupies an inner position nearer the front face 9 of the device as shown in FIG. 6. During their movement along the channels, the free ends of the limbs 19' abut against the lugs 32 of the cam member 5' and cause the cam member to pivot about spindle 7. The cam member 5' continues its pivotal movement under the effect of its eccentric mounting and its out-of-balance caused by the mass 35 if present and hence protrudes through opening 6 so that the coating 34 engages with the floor and the cam member 5' is in its operating position. Any attempt to open the door further merely causes the cam member 5' to engage more firmly with the floor. Thus, further opening of the door is successfully prevented.

As the cam member 5' moves into its operating position as shown in FIG. 6, the gear teeth 33 on the cam member 5' drive the serrations 24 of the limbs 23' and thus cause the lever 21' to move from an inner position adjacent to the front face 9 of the device (as shown in FIG. 7) to an outer position wherein it is spaced from the front face 9 of the device (as shown in FIG. 6). When it is desired to de-actuate the device, the lever 21' is returned from its outer position to its inner position thereby causing cam member 5' to pivot in the opposite direction as a consequence of the engagement of the serrations 24 with the gear teeth 33 on the cam member 5'. Thus, the cam member 5' is pivoted back into the housing and retained in its retracted position by interengagement of the coating 37 and the roof of the housing 4. The door can then be opened. During this pivotal movement of the cam member 5', the lugs 33 act against the free ends of the limbs 19' of the lever 18' and cause the lever to return to its outer position as shown in FIG. 7 wherein it is ready for further use when desired.

Instead of being formed of a metal, spindle 7 may be formed of synthetic plastics material integrally moulded with the cam member. In this case, the spindle 7 may be simply snapped into engagement with appropriate apertures or recesses in the side members 2 and 3.

I claim:

1. A device for restricting the opening motion of a door so as to prevent unauthorized entry via the door comprising:

a housing for securing to the door and having an opening facing the floor over which the door moves when being opened and closed;

a bistable cam member mounted for pivotal movement about a pivotal axis within the housing between a first stable position which is an operating position in which said cam member extends through said opening to engage with the floor thereby preventing movement of the door with respect to the floor, and a second stable position in which said cam member is retracted away from the floor; and means for displacing said cam member between said first and second stable positions.

2. A device as claimed in claim 1, wherein said cam member is in the form of a roller mounted for pivotal movement about an eccentric axis.

3. A device as claimed in claim 1, wherein said cam member is in the form of part only of a roller mounted for pivotal movement about an eccentric axis.

4. A device as claimed in claim 1 wherein: said cam member is provided with gear teeth concentrically arranged about said pivotal axis and said means for displacing said cam member comprises at least one reciprocable member having serrations engageable with said gear teeth for pivoting said cam member during reciprocation of said reciprocable member.

5. A device as claimed in claim 1, wherein: said cam member comprises an abutment and said means for displacing said cam member comprises at least one reciprocable member located so as to engage with said abutment for pivoting said cam member during reciprocation of said reciprocable member.

6. A device as claimed in claim 1 wherein said cam member is formed of synthetic plastics material provided with a rubber coating.

* * * * *